US005853556A

United States Patent [19]

Wieczerniak

[11] Patent Number: 5,853,556

[45] Date of Patent: Dec. 29, 1998

[54] USE OF HYDROXY CARBOXYLIC ACIDS AS DUCTILIZERS FOR ELECTROPLATING NICKEL-TUNGSTEN ALLOYS

[75] Inventor: Walter J. Wieczerniak, Shelby Township, Mich.

[73] Assignee: Enthone-OMI, Inc., Warren, Mich.

[21] Appl. No.: 861,894

[22] Filed: May 22, 1997

Related U.S. Application Data

[63] Continuation of Ser. No. 615,133, Mar. 14, 1996, abandoned.

[51] Int. Cl.[6] ..... C25D 3/56; C25D 21/18

[52] U.S. Cl. ..... 205/101; 205/238

[58] Field of Search ..... 205/101, 238, 205/255, 261

[56] References Cited

U.S. PATENT DOCUMENTS

| | | | |
|---|---|---|---|
| 2,653,128 | 9/1953 | Brenner et al. | 205/238 |
| 3,616,437 | 10/1971 | Yagishita | 204/232 |
| 3,844,906 | 10/1974 | Bailey et al. | 205/73 |
| 4,129,482 | 12/1978 | Lash | 205/260 |
| 4,379,031 | 4/1983 | Krotkwiewicz et al. | 205/100 |
| 4,529,668 | 7/1985 | Croopnick et al. | 428/665 |
| 4,543,166 | 9/1985 | Lash | 205/246 |
| 4,600,609 | 7/1986 | Leever et al. | 427/438 |
| 5,389,226 | 2/1995 | Scruggs et al. | 205/50 |
| 5,525,206 | 6/1996 | Wieczerniak et al. | 205/238 |

FOREIGN PATENT DOCUMENTS

| | | |
|---|---|---|
| 56-123396 | 9/1981 | Japan . |
| 621.357.7 | 4/1976 | U.S.S.R. . |
| 6213577 | 4/1976 | U.S.S.R. . |

*Primary Examiner*—Kathryn L. Gorgos
*Assistant Examiner*—William T. Leader
*Attorney, Agent, or Firm*—Harness, Dickey & Pierce, P.L.C.

[57] ABSTRACT

A process for tungsten alloy plating wherein a tungsten replenisher concentrate of tungsten ions pre-complexed with a hydroxy carboxylic acid is used for maintenance additions to the bath. A preferred additive includes from about 100 to about 120 g/l of tungsten ions complexed with from about 120 to about 220 g/l of citric acid. The process provides consistent cathode efficiency and produces ductile deposits of tungsten alloy electroplate.

20 Claims, 3 Drawing Sheets

AVERAGE: 39.71%
VARIANCE: 1.562
STD.DEV.:1.235
MEAN DEV.:0.959

AVERAGE: 34.74%
VARIANCE: 9.256
STD.DEV.:3.042
MEAN DEV.:2.53

AVERAGE: 37.25%
VARIANCE: 7.279
STD.DEV.:2.698
MEAN DEV.:2.29

AVERAGE: 40.36%
VARIANCE: 1.729
STD.DEV.:1.315
MEAN DEV.:1.1

AVERAGE: 40.25%
VARIANCE: 5.15
STD.DEV.:1.235
MEAN DEV.:1.82

AVERAGE: 39.71%
VARIANCE: 1.562
STD.DEV.:1.235
MEAN DEV.:0.959

USE OF HYDROXY CARBOXYLIC ACIDS AS DUCTILIZERS FOR ELECTROPLATING NICKEL-TUNGSTEN ALLOYS

This is a continuation of U.S. Pat. application Ser. No. 08/615,133, filed Mar. 14, 1996, now abandoned.

BACKGROUND OF THE INVENTION

The present invention relates to tungsten alloy electroplating baths. More specifically, the present invention relates to an additive for replenishing tungsten metal in the bath. This allows for improved cathode efficiency and reduces fluctuations in cathode efficiencies when adding tungsten ions to the bath.

In recent years, replacements for hard chrome electroplating have been desirable due to increasingly stringent environmental standards and costs associated with hard chromium plating. One promising replacement for chromium electroplating is tungsten alloy electroplating. Tungsten alloy electroplating and particularly alloys of tungsten with nickel, iron and cobalt provide many of the desirable properties of hard chromium. These deposits have the appearance of chromium, but the processes do not have the effluent disposal drawbacks associated with chromium electroplating baths.

Typically in such baths, water soluble salts of nickel, cobalt, iron or mixtures of these are used in combination with water soluble tungsten salts to produce tungsten alloy deposits on various conductive substrates. These baths typically contain high levels of tungsten, of from about 4 to about 100 g/l, and low levels of nickel in the range of about 5 g/l. Typically, these baths also include some type of complexing agent to provide proper complexing of the nickel, cobalt or iron salts, as well as ammonium ions. Of course as plating from the bath continues, it is necessary to replenish tungsten and nickel into the bath for continued plating from the bath. Typically this is accomplished in the case of nickel by adding a water soluble nickel salt. Whereas in the case of tungsten, either ammonium tungstate or sodium tungstate dihydrate are utilized in their salt forms for additions to the bath. Such additions are typically made with "dry" salts since this is the most convenient method.

This method was generally believed to be adequate for use in tungsten plating baths. However, upon plating from such baths, it was noticed that fluctuations in the cathode efficiency were occurring after addition of the tungsten salt replenishers were made. Initially, it was believed that lack of or ineffectiveness of brightening agents in the bath was responsible for these fluctuations in that after a period of time the baths seemed to stabilize and work as desired. Of course this resulted in severe down time in the plating bath, or if the bath was used, sub standard plating occurred.

Thus, there was a need in the art to determine what caused these cathode efficiency fluctuations and how this problem could be remedied.

SUMMARY OF THE INVENTION

In accordance with the present invention, there is provided a process for the continued effective electroplating of tungsten alloys from a tungsten alloy bath, even after replenishing additions of tungsten have been made. The process of the present invention provides a plating bath with improved stability, greater cathode efficiency, and produces deposits with improved ductility. These improvements result from having the nickel and tungsten in the precomplexed state when replenishing additions of these are made.

The process includes electroplating of a tungsten alloy coating onto a cathode from a tungsten alloy electroplating bath in which replenishing additions of nickel and tungsten are supplied by precomplexed liquid concentrates prior to addition to the bath. The plating bath includes an effective amount of tungsten ions, an effective amount of metal ions selected from the group of nickel, iron, cobalt and mixtures thereof, an effective amount of a hydroxy carboxylic acid, and an effective amount of ammonium ions. The nickel replenisher includes an effective amount of a nickel salt precomplexed with a hydroxy carboxylic acid, while the tungsten replenisher includes an effective amount of a tungsten salt precomplexed with a hydroxy carboxylic acid. The resulting additives stabilize cathode efficiency immediately after addition to the bath.

Further understanding of the present invention will be had by reference to the following drawings, the description of the preferred embodiments, and claims appended hereto.

DETAILED DESCRIPTION OF THE PREFERRED EMBODIMENTS

Figure 1:
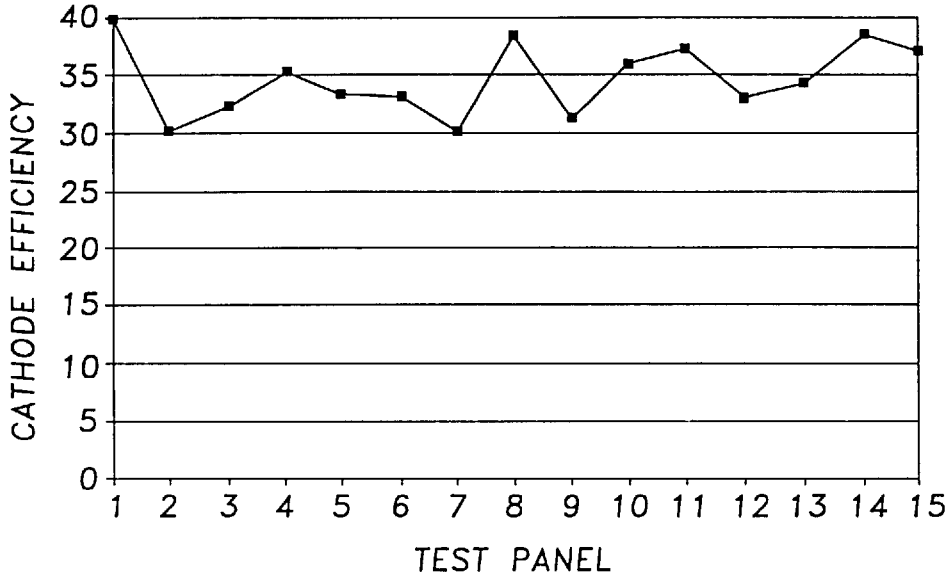
FIG. 1 is a graph showing cathode efficiency of a tungsten electroplating process using prior art methods of making tungsten additions.
Figure 2:
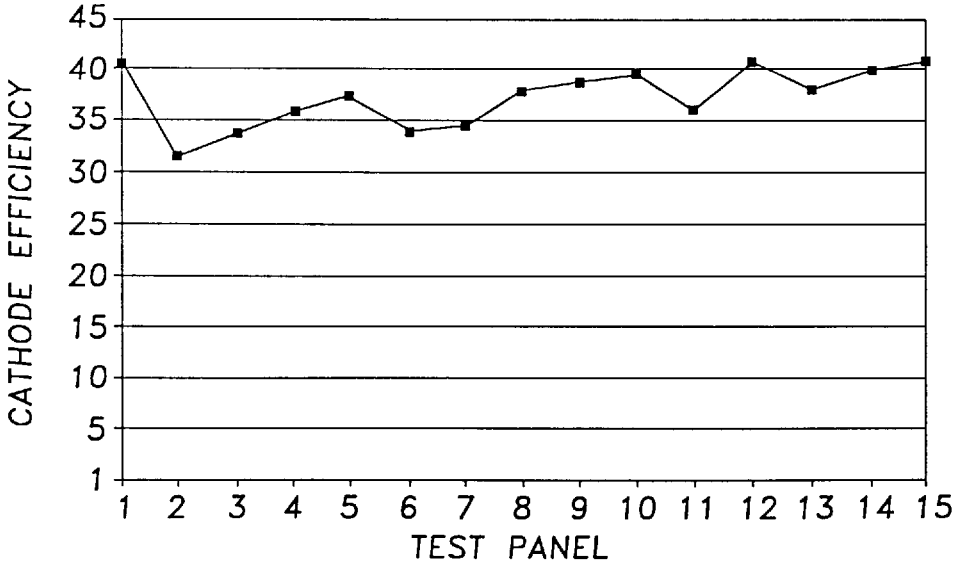
FIG. 2 is a graph showing cathode efficiency when initially using the additives of the present invention.
Figure 3:
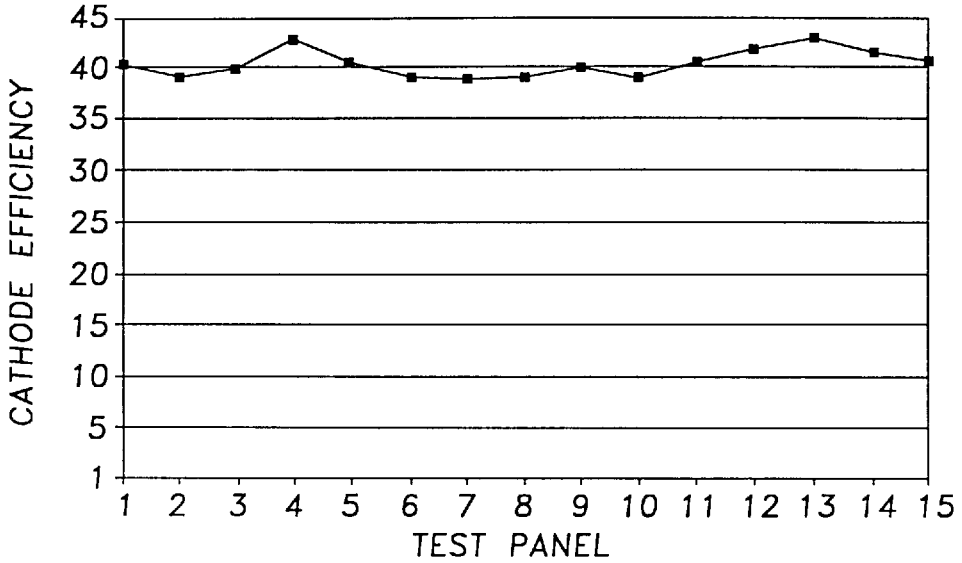
FIG. 3 is a graph showing cathode efficiency with a separate formulation of the additives of the present invention.
Figure 4:
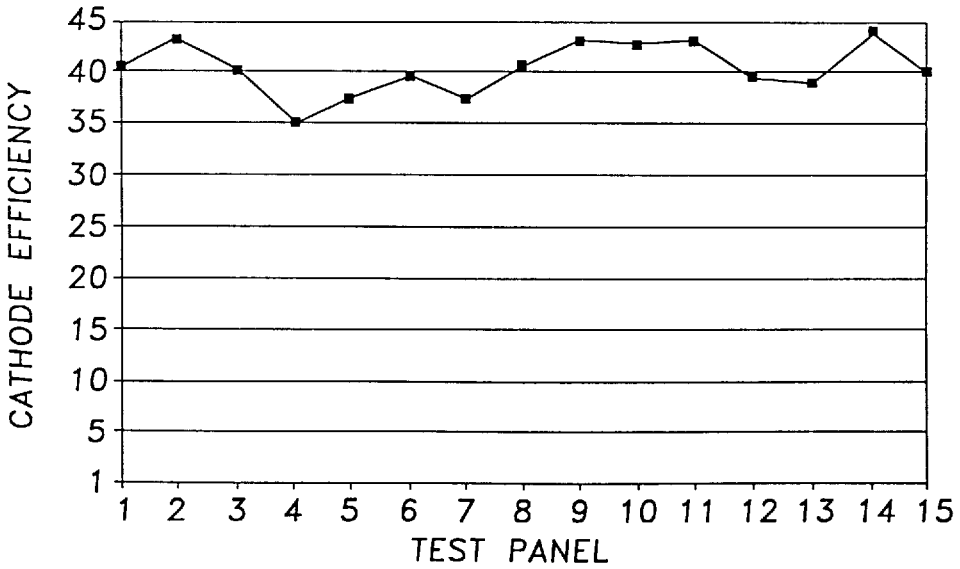
FIG. 4 is a graph showing cathode efficiency of a still further additive of the present invention.

In accordance with the present invention, there is provided a process for electroplating of tungsten alloys with consistent cathode efficiency, producing improved ductile deposits of tungsten alloy electroplates. The process in this broad aspect includes addition of replenishing amounts of a tungsten additive, which is a tungsten salt precomplexed in a hydroxy carboxylic acid having from about 1 to about 6 carbon atoms.

The process includes the steps of first providing a suitable tungsten alloy electroplating bath. Thereafter, tungsten alloy electroplating is accomplished onto a cathodic element. In the process of the present invention, replenishing additions of tungsten ions, which have been precomplexed in a hydroxy carboxylic acid, are added to the bath for maintaining constant tungsten levels in the bath and to improve the overall ductility of deposits produced from the bath.

Tungsten alloy electroplating baths of the present invention typically include: tungsten ions; a compatible alloying metal, such as nickel, cobalt or iron; ammonium ions; and typically a complexing agent. Typically, the tungsten is provided in the bath in the form of salts of tungsten, with ammonium tungstate and sodium tungstate dihydrate being preferred salts of the present invention. Baths of the present invention typically will include from about 4 to about 100 g/l tungsten ions, with preferred baths including from about 10 to about 70 g/l tungsten ions. Typically, the alloying metal is a bath soluble salt of nickel, cobalt, iron or mixtures thereof. These salts are typically found in sulfate or carbonate forms. A preferred bath of the present invention is a nickel-tungsten bath wherein tungsten is used in ranges of from about 1 to about 50 g/l, with preferred ranges of nickel ions being from about 2.5 to about 16 g/l. Cobalt may also be utilized in this solution if desired, in amounts of from about 6 to about 150 g/l, with preferred cobalt ranges being from about 3 to about 100 g/l. Likewise, when iron is used in such a bath, there is generally required from about 5 to about 140 g/l iron ions, with preferred amounts of iron ions being from about 25 to about 75 g/l.

Complexing agents useful in the present invention include those commonly used in other plating baths, such as citrates, gluconates, tartrates, and other alkyl hydroxy carboxylic acids. Generally in the initial bath, such complexing agents are used in amounts of from about 10 to about 150 g/l, with preferred amounts being from about 20 to about 100 g/l. Preferred baths of the present invention include a source of ammonium ions. Typically, ammonium ions in the range of from about 5 to about 30 g/l are useful in the baths, however, additional ammonium ions above and beyond these levels stresses deposits and results in increased cracking of the deposits.

The baths of the present invention are generally provided in a pH range of from about 6 to about 9, with typical ranges in pH being from about 7 to 8, and preferred ranges being from about 7.3 to about 7.8. The operable temperature range of baths of the present invention is from about 70° F. to about 190° F., with typical ranges of temperature being from about 140° F. to 160° F. Preferably, baths of the present invention are operated at temperatures of from about 145° F. to about 150° F.

It is critical in the practice of the present invention to maintain the tungsten level in the bath by using a concentrated tungsten additive solution comprising tungsten ions which are precomplexed in a hydroxy carboxylic acid, having from 1 to about 6 carbon atoms. Preferred acid for precomplexing this tungsten additive, include citric acid, EDTA, nitrilotriacetic acid, tartaric acid and mixtures thereof. A particularly preferred acid for use in precomplexing the tungsten prior to bath maintaining additions is citric acid.

These concentrated bath additives in accordance with the present invention have molar ratios ranging from about 1 mole acid to about 4 moles acid for every 1 mole tungsten ions. Preferably, the ratio is from about 1 mole of acid per 1 mole of tungsten ions to about 2 moles of acid per 1 mole of tungsten ions. Typically, these concentrated additives range in quantities of citric acid of from about 100 to about 200 g/l citric acid, mixed with about 50 to about 220 g/l tungsten metal ions. Preferred concentrated additives include from about 100 to about 120 g/l tungsten ions complexed with from about 120 to about 220 g/l citric acid. A particularly preferred concentrated additive includes from about 95 to about 125 g/l tungsten ions with from about 100 to about 175 g/l citric acid.

Preferably, the concentrates of the present invention are formulated with about 112 g/l tungsten ions complexed in an aqueous solution of citric acid. The source of the tungsten ions is preferably ammonium tungstate, sodium tungstate dihydrate or mixtures thereof. A preferred additive includes from about 0–50 g/l ammonium tungstate and from about 100 to about 300 g/l sodium tungstate dihydrate. In a second preferred embodiment, the source of tungsten is a mixture of citric acid and sodium tungstate dihydrate in amounts of from about 150 to about 300 g/l. A preferred composition contains 200 g/l sodium tungstate dihydrate. Any known practices of monitoring tungsten levels and making additions to the bath may be utilized.

It has been found that the tungsten replenishing system of the present invention is well suited to use when a precomplexed replenisher concentrate for nickel is also used. This nickel replenishing composition includes from about 40 to about 80 g/l nickel ions, from about 40 to about 225 g/l citric acid, and from about 40 to about 100 g/l ammonium ions.

It has been found that when using replenishers in accordance with the present invention, immediate use of the tungsten alloy bath is possible without any type of stabilization period. In accordance with the present invention, making additions of tungsten concentrate to the tungsten alloy plating bath resulted in the cathode efficiency being maintained at values approximating those which were present in the original bath. Also, the ductility of the tungsten alloy deposit is improved, thus making the deposit less prone to cracking.

A further understanding of the present invention will be had with reference to the examples set forth below by way of illustration but not limitation.

EXAMPLE 1

A testing bath of nickel-tungsten electrolyte was made using the constituents set forth in Table I.

TABLE I

| | |
|---|---|
| $Ni^{++}$ | 5 g/l |
| $Na_2WO_4.2H_2O$ | 50 g/l (27.8 g/l $W^{+6}$) |
| $H_3C_6H_5O_7$ | 60 g/l |
| $NH^+_4$ | 10 g/l |
| pH | 7.3–7.8 |

The nickel concentration was maintained in the above bath by additions of a nickel replenishing concentrate of 160 g/l nickel carbonate, 160 g/l citric acid, and 350 g/l ammonium carbonate.

Referring now to FIGS. 1 through 5, there is shown results of various tests using various additives for maintaining tungsten in the baths. These additives are set forth below in Table II.

TABLE II

| Additive Sample | A | B | C | D | E |
|---|---|---|---|---|---|
| Ammonium Tungstate | 150 g/l | 150 g/l | 150 g/l | — | 38 g/l |
| Sodium Tungstate Dihydrate | — | — | — | 200 g/l | 150 g/l |
| Citric Acid | — | 100 g/l | 175 g/l | 100 g/l | 100 g/l |
| pH | 3.6 | 7.5 | 7.9 | 7.8 | 7.9 |

Item A above is a comparison of use of the prior additives for replenishing tungsten electroplating baths. Additives B through E are additives in accordance with the present invention. Each of these formulations include 112 g/l of tungsten ions. Each of these replenishers were tested separately in freshly prepared electrolytes in accordance with the formula of Table I. Each of the baths for electrolytes is operated for a period of 120 amp hours with the additions of bath replenishers made every 8 amp hours to maintain the bath balance. At each interval, the cathodes were weighed and cathode efficiency was calculated. The graphic results are shown in FIGS. 1 through 5. Table III, set forth below, sets forth the test results for each of the replenisher samples labeled A–E shown in FIGS. 1 through 5.

TABLE III

| Additions/Panel | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| | | | | | | | A | | | | | | | | |
| ml/l Nickel Replenisher | — | 12.5 | 12.5 | 12.5 | 12.5 | 12.5 | 12.5 | 12.5 | 12.5 | 12.5 | 12.5 | 12.5 | 12.5 | 12.5 | 12.5 |
| ml/l Tungsten Replenisher | — | 3.75 | 3.75 | 3.75 | 3.75 | 3.75 | 3.75 | 3.75 | 3.75 | 3.75 | 3.75 | 3.75 | 3.75 | 3.75 | 3.75 |
| % Cathode Efficiency | 39.9 | 30.2 | 32.3 | 35.6 | 33.3 | 33.2 | 30 | 38.5 | 31.3 | 36.5 | 37.3 | 33.2 | 34.2 | 38.5 | 37.1 |
| | | | | | | | B | | | | | | | | |
| ml/l Nickel Replenisher | — | 12.5 | 12.5 | 12.5 | 12.5 | 12.5 | 12.5 | 12.5 | 12.5 | 12.5 | 12.5 | 12.5 | 12.5 | 12.5 | 12.5 |
| ml/l Tungsten Replenisher | — | 3.75 | 3.75 | 3.75 | 3.75 | 3.75 | 3.75 | 3.75 | 3.75 | 3.75 | 3.75 | 3.75 | 3.75 | 3.75 | 3.75 |
| % Cathode Efficiency | 40.3 | 31.6 | 33.7 | 36.1 | 37.7 | 34 | 34.5 | 38.1 | 38.8 | 39.3 | 36.2 | 40.5 | 37.8 | 39.8 | 40.4 |
| | | | | | | | C | | | | | | | | |
| ml/l Nickel Replenisher | — | 12.5 | 12.5 | 12.5 | 12.5 | 12.5 | 12.5 | 12.5 | 12.5 | 12.5 | 12.5 | 12.5 | 12.5 | 12.5 | 12.5 |
| ml/l Tungsten Replenisher | — | 3.75 | 3.75 | 3.75 | 3.75 | 3.75 | 3.75 | 3.75 | 3.75 | 3.75 | 3.75 | 3.75 | 3.75 | 3.75 | 3.75 |
| % Cathode Efficiency | 40.1 | 39 | 39.7 | 42.6 | 40.7 | 38.8 | 38.8 | 38.8 | 39.8 | 39.6 | 40.4 | 41.8 | 42.9 | 41.6 | 40.8 |
| | | | | | | | D | | | | | | | | |
| ml/l Nickel Replenisher | — | 12.5 | 12.5 | 12.5 | 12.5 | 12.5 | 12.5 | 12.5 | 12.5 | 12.5 | 12.5 | 12.5 | 12.5 | 12.5 | 12.5 |
| ml/l Tungsten Replenisher | — | 3.75 | 3.75 | 3.75 | 3.75 | 3.75 | 3.75 | 3.75 | 3.75 | 3.75 | 3.75 | 3.75 | 3.75 | 3.75 | 3.75 |
| % Cathode Efficiency | 40.6 | 42.6 | 39.8 | 35.1 | 37.7 | 39.2 | 37.7 | 40.6 | 42.7 | 42.4 | 42.7 | 39.7 | 39.2 | 43.8 | 40 |
| | | | | | | | E | | | | | | | | |
| ml/l Nickel Replenisher | — | 12.5 | 12.5 | 12.5 | 12.5 | 12.5 | 12.5 | 12.5 | 12.5 | 12.5 | 12.5 | 12.5 | 12.5. | 12.5 | 12.5 |
| ml/l Tungsten Replenisher | — | 3.75 | 3.75 | 3.75 | 3.75 | 3.75 | 3.75 | 3.75 | 3.75 | 3.75 | 3.75 | 3.75 | 3.75 | 3.75 | 3.75 |
| % Cathode Efficiency | 37.6 | 37.3 | 40.6 | 38.3 | 39.1 | 40.1 | 39.1 | 40.6 | 39.8 | 39.7 | 39.7 | 40.9 | 42.1 | 40.6 | 40.2 |

Figure 5:
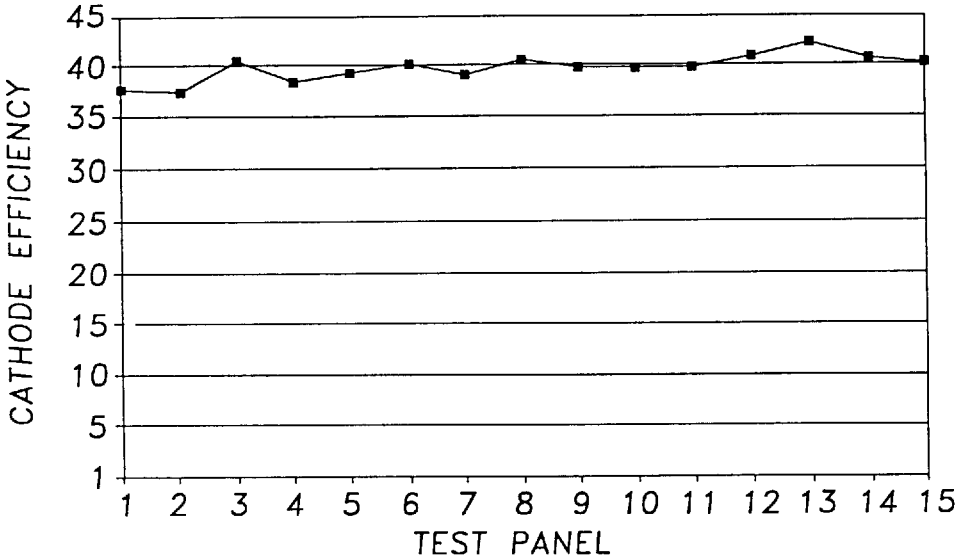
FIG. 5 is a graph showing cathode efficiency of a still further additive of the present invention.

As can be seen by comparing FIG. 1 of the prior art additive sample A, the cathode efficiency is substantially increased when using the replenishing additives of the present invention, as shown in FIGS. 2 through 5. FIG. 5 is a preferred embodiment of the present invention, which shows substantially flat cathode efficiency at or about 40% throughout the process using the preferred additives of the present invention.

While the above specification and exemplification was given for purposes of disclosing the preferred embodiments of the present invention, it is not to be construed to be limiting of the present invention.

It will be readily appreciated by those skilled in the art that the present invention can be practiced other than as specifically stated. Thus, the invention may be subject to modification, variation and change without departing from the proper scope and fair meaning of the accompanying claims.

What is claimed is:

1. A process for continued electroplating of tungsten alloys with greater cathode efficiency and producing improved ductile deposits comprising electroplating of a tungsten alloy plate from a bath comprising:

an effective amount of tungsten ions;

an effective amount of metal ions selected from the group consisting of nickel, iron, cobalt and mixtures thereof;

an effective amount of a hydroxy carboxylic acid and an effective amount of ammonium ions; and replenishing the above bath with tungsten ions by addition of an effective amount of a tungsten replenishing additive consisting essentially of ionic tungsten complexed with a hydroxy carboxylic acid prior to addition to the bath, said effective amount being sufficient for restoring tungsten ion concentration which was depleted from the bath during electroplating, whereby the cathode efficiency is improved and the ductility of the deposit is improved.

2. The process of claim 1 wherein the acid is selected from the group consisting of: citric acid, EDTA, nitrilotriacetic acid, tartaric acid and mixtures thereof.

3. The process of claim 2 wherein the ratio is from about 1 mole of acid per 1 mole of tungsten ions to about 2 moles of acid per one mole of tungsten ions.

4. The process of claim 3 wherein citric acid is used in amounts of from about 120 to about 220 g/l.

5. The process of claim 1 wherein the tungsten additive has a molar ratio of from about 1 mole of hydroxy carboxylic acid to 1 mole of tungsten ions to about 4 moles of the hydroxy carboxylic acid to 1 mole of tungsten ions, wherein the hydroxy carboxylic acid has from about 1 to about 6 carbon atoms.

6. The process of claim 5 wherein tungsten is used in amounts of 100 to 120 g/l.

7. The process of claim 1 wherein the tungsten additive contains from about 100 to about 200 g/l hydroxy carboxylic acid, and from about 50 to about 220 g/l tungsten metal ions.

8. The process of claim 1 wherein replenishing additions of nickel are made using a nickel citrate complexed solution.

9. A process for replenishing a tungsten alloy electroplating bath with tungsten metal comprising:

(1) providing a suitable tungsten alloy electroplating bath;

(2) electroplating a tungsten alloy onto a cathodic element; and (3) making replenishing additions of tungsten ions to the bath by first preparing a complexed tungsten additive consisting essentially of tungsten ions and a hydroxy carboxylic acid having from 1–6 carbon atoms, and adding this complexed tungsten additive to the bath for replenishing the bath.

10. The process of claim 9 where the hydroxy carboxylic acid is selected from the group consisting of: citric acid, EDTA, nitrilotriacetic acid, tartaric acid and mixtures thereof.

11. The process of claim 9 wherein the bath is replenished with a concentrate comprising from about 50 to about 220 g/l tungsten metal ions, and from about 100 to about 220 g/l hydroxy carboxylic acid.

12. The process of claim 9 wherein the bath is replenished with a tungsten concentrate which has a molar ratio range of from about 1 mole hydroxy carboxylic acid per 1 mole of tungsten ions to from about 1 mole of hydroxy carboxylic acid per 4 moles of tungsten ions.

13. The process of claim 9 wherein the hydroxy carboxylic acid is citric acid.

14. The process of claim 9 wherein the bath is replenished with a concentrate which comprises a mixture of from about 100 to about 120 g/l tungsten metal ions, and from about 120 to about 220 g/l citric acid.

15. The process of claim 9 wherein the bath is replenished with a concentrate which comprises an aqueous mixture of from about 95 to about 125 g/l of tungsten ions, and from about 100 to about 175 g/l citric acid.

16. A process for replenishing tungsten ions in a tungsten alloy electroplating bath comprising:

(1) providing a tungsten alloy electroplating bath including an effective amount of tungsten ions; an effective amount of metal ions selected from the group consisting of nickel, iron, cobalt and mixtures thereof; an effective amount of a hydroxy carboxylic acid; and an effective amount of ammonium ions;

(2) electroplating a tungsten alloy from the electroplating bath; and (3) replenishing tungsten ions in the bath with a concentrate mixture consisting essentially of from about 50 to about 220 grams of tungsten ions, and from about 100 to about 200 grams of citric acid.

17. The process of claim 16 wherein the tungsten in the concentrate is an aqueous mixture of a tungsten component selected from the group consisting of: ammonium tungstate, sodium tungstate dihydrate and mixtures thereof; and citric acid.

18. The process of claim 17 wherein the concentrate includes from about 0 to about 50 g/l ammonium tungstate, and from about 100 to about 300 g/l sodium tungstate dihydrate.

19. The bath of claim 18 wherein the molar ratio is from about 1 mole citric acid per 1 mole of tungsten ions to from about 4 moles citric acid per mole of tungsten ions.

20. The process of claim 17 wherein the concentrate includes from about 150–300 g/l sodium tungstate dihydrate.

* * * * *